US008141970B2

(12) United States Patent
Noll

(10) Patent No.: US 8,141,970 B2
(45) Date of Patent: Mar. 27, 2012

(54) METHOD AND DEVICE FOR DECORATING AN UNEVEN SURFACE OF A DIMENSIONALLY STABLE OBJECT

(75) Inventor: Werner Noll, Huebingen (DE)

(73) Assignee: Ball Packaging Europe GmbH, Ratingen (DE)

( * ) Notice: Subject to any disclaimer, the term of this patent is extended or adjusted under 35 U.S.C. 154(b) by 493 days.

(21) Appl. No.: 12/374,056

(22) PCT Filed: Jul. 20, 2007

(86) PCT No.: PCT/DE2007/001299
§ 371 (c)(1),
(2), (4) Date: Feb. 17, 2009

(87) PCT Pub. No.: WO2008/009284
PCT Pub. Date: Jan. 24, 2008

(65) Prior Publication Data

US 2009/0251523 A1 Oct. 8, 2009

(30) Foreign Application Priority Data

Jul. 20, 2006 (DE) ..... 10 2006 034 060

(51) Int. Cl.
*B41J 25/308* (2006.01)

(52) U.S. Cl. ..... 347/8; 347/14; 347/2; 347/4; 347/106

(58) Field of Classification Search ..... 347/8, 14, 347/2, 4, 106, 37, 19, 5, 9
See application file for complete search history.

(56) References Cited

U.S. PATENT DOCUMENTS 4,842,887 A * 6/1989 Bolte ..... 427/10
5,815,282 A * 9/1998 Kano ..... 358/296
6,069,778 A * 5/2000 Kano et al. ..... 360/132
6,769,357 B1 8/2004 Finan (Continued)

FOREIGN PATENT DOCUMENTS

CA 1277176 12/1990

(Continued)

OTHER PUBLICATIONS

International Search Report (including translation) for International (PCT) Application No. PCT/DE2007/001299, completed Nov. 29, 2007.

(Continued)

*Primary Examiner* — Matthew Luu
*Assistant Examiner* — Henok Legesse
(74) *Attorney, Agent, or Firm* — Sheridan Ross P.C.

(57) ABSTRACT

A method for decorating an uneven surface of a dimensionally stable object is disclosed. According to the method, the object to be decorated and a digital, contactless printing head are moved in relation to one another during the printing operation and the printing head is controlled by a control unit in order to dispense ink. The method according to the invention comprises the following steps: a control program is created to control the printing head in accordance with the height profile of the uneven surface to be decorated of the object; the position of the surface to be decorated is detected in relation to the printing head; and the digital printing head is controlled using the program that has been created. The invention also relates to a device for carrying out the method.

21 Claims, 4 Drawing Sheets

U.S. PATENT DOCUMENTS

| | | | |
|---|---|---|---|
| 7,357,959 | B2 | 4/2008 | Bauer |
| 2001/0003871 | A1 | 6/2001 | Patton et al. |
| 2001/0017085 | A1 | 8/2001 | Kubo et al. |
| 2001/0019340 | A1 | 9/2001 | Kubo et al. |
| 2005/0255249 | A1 | 11/2005 | Schlatterbeck et al. |
| 2006/0144261 | A1 | 7/2006 | Uptergrove |

FOREIGN PATENT DOCUMENTS

| | | | |
|---|---|---|---|
| CH | 695555 | | 6/2006 |
| DE | 3603126 | | 8/1987 |
| DE | 20007200 | | 7/2000 |
| DE | 10031030 | | 1/2002 |
| DE | 10 2004 025140 | A | 12/2005 |
| EP | 0209896 | | 1/1987 |
| EP | 1038689 | | 9/2009 |
| JP | 2000-006493 | | 1/2000 |
| JP | 2001-270096 | | 10/2001 |
| WO | WO 03/099456 | | 12/2003 |
| WO | 2004007203 | | 1/2004 |

OTHER PUBLICATIONS

Written Opinion (including translation) for International (PCT) Application No. PCT/DE2007/001299, completed Nov. 29, 2007.

International Preliminary Report on Patentability (including translation) for International (PCT) Application No. PCT/DE2007/001299, issued Mar. 17, 2009.

Examination Report (including English translation) issued by the German Patent and Trademark Office for German application No. DE 102006034060, dated Oct. 23, 2007.

* cited by examiner

METHOD AND DEVICE FOR DECORATING AN UNEVEN SURFACE OF A DIMENSIONALLY STABLE OBJECT

CROSS-REFERENCE TO RELATED APPLICATIONS

This application is a 371 of PCT/DE2007/001299 filed Jul. 20, 2007, which in turn claims priority of de 10 2006 034 060.4 filed Jul. 20, 2006, the priority of both applications is hereby claimed and both applications are hereby incorporated by reference herein.

BACKGROUND OF THE INVENTION

The invention concerns a method of and apparatus for decorating an uneven surface on an object which is stable in respect of shape, in particular for decorating a bottom of a beverage can.

In two-part aluminum or tin plate beverage cans available on the market nowadays, the actual Body portion of the can is produced from a single sheet metal portion in a stretching and drawing shaping process. Usually the bottom has a domed portion which goes into an annular ridge providing the surface on which the can body portion stands. The described three-dimensional profile of the can bottom makes it difficult to lacquer or print on that region of the can. In that respect there is also the need for the portion of the can which provides the surface on which it stands to be provided with a thicker coat of lacquer to take account of the higher mechanical loading in that region.

A bottom lacquering machine for such cans is known in the art, with which the entire can bottom is spray-lacquered with a solvent paint. Exact lacquer distribution is not possible with such a method. To provide the necessary abrasion resistance in the region of the bottom support surface additional lacquering of that surface is carried out after spray lacquering of the entire bottom. The described method of lacquering the bottom of a beverage can suffers however on the one hand from the disadvantage that the spray lacquering operation results in the formation of a lacquer mist which is also referred to as overspray and which causes an increased consumption of lacquer and requires suction removal measures to prevent that lacquer mist from being deposited at other locations on the can or to clean the air affected thereby. At the same time the described method also requires overlacquering of the body portion of the can as it is not possible to lacquer defined portions with a spray lacquering process, but only roughly differentiated portions. Spray lacquering the bottom of the can in addition also suffers from the disadvantage that solvent-bearing lacquers are generally used in that case, and they entail in particular pertinent environmentally related problems.

A further known method of lacquering the bottom of a beverage can includes three method steps, wherein the bottom support surface and the transitional region of the bottom to the peripheral surface of the can are lacquered by means of a roll application and the dome region of the bottom is lacquered by means of a spray application. Admittedly no overspray is produced by such a method, but the three process steps specified make the method comparatively complicated and expensive.

At any event with the known methods the bottom support surface of the can is passed through a roller lacquering means in a mass transport mode, a UV hardening lacquer generally being employed. Upon closer consideration of such a roller lacquering means however it is found that the contact pressure with which the application roller presses against the can and the bottom support surface of the can respectively must be very accurately controlled as otherwise the lacquer is forced laterally away from the center line of the bottom support surface. That causes a reduction in the thickness of lacquer on the center line of the bottom support surface where the aim is precisely to have a greater amount of lacquer. As the roller lacquering operation is carried out in mass transport of the cans, minor differences in the can height can occur and in addition the application roller cannot be held in every case parallel to the conveyor belt, the lacquer thicknesses which can be produced in the region of the bottom support surface can be kept within predetermined limits only with difficulty.

SUMMARY OF THE INVENTION

The object of the invention is to provide a method and an apparatus with which the described disadvantages of the state of the art can be at least partially remedied.

In a surprisingly simple fashion the invention attains the specified object with a method of decorating an uneven surface of an object which is stable in respect of shape such as a bottom of a beverage can, wherein the object to be decorated and a digitally and contactlessly operating printing head are moved relative to each other during the printing operation and the printing head is actuated by a control device for dispensing paint. The method according to the invention includes the step of creating a control program for controlling the printing head in dependence on the height profile of the uneven surface to be decorated of the object, the step of detecting the relative position of the surface to be decorated of the object relative to the printing head and the step of actuating the digital printing head with the created control program for decorating the object.

The invention is based on the idea of carrying out the decoration step, that is to say lacquering and/or printing on objects which are stable in respect of shape and which have a surface to be decorated which is not flat but includes a height profile, with a conventional, contactlessly operating printing device, the printing device being actuated in dependence on the height profile of the surface to be decorated. The fact that the surface to be decorated has a height profile means that the spacing between the printing device and the surface to be decorated is not constant but varies when the object is moved past the printing head. In that respect also the impingement angle of the paint on the surface to be decorated thus also varies. The effects on the printing procedure, caused by the variable spacing, are compensated in accordance with the invention by actuation of the printing head, which is adapted to that height profile.

The method according to the invention is not limited to the use of lacquering the bottom of a beverage can but can be quite generally carried out when an object is to be decorated, in which the surface to be decorated is inclined relative to the printing head and in that respect the surface to be decorated has a height profile in relation to the printing head. The terms height profile and topography are to be interpreted synonymously here. The same applies for the terms lacquer, paint and ink.

The invention concerns decorating objects which are stable in respect of shape, that is to say objects which retain their configuration in spite of the effect of gravity. They can include for example glass, porcelain, ceramic, plastic material, metals or other materials.

It may be desirable if prior to the decoration operation a desired paint layer thickness is established in dependence on the location on the uneven surface to be decorated of the object and the control program is created in dependence on the predetermined height profile of the surface to be decorated and the desired paint layer thickness, wherein the digital printing head is controlled with the created control program in response to the topography of the uneven surface to be decorated to produce the predetermined desired paint layer thickness. In that case depending on the respective use involved the desired paint layer thickness can be the same over the entire surface to be decorated or can also vary in any desired fashion. For example it is possible to specify for the desired paint layer thickness a functional relationship in dependence on the positional coordinates of the surface to be decorated. In that case for actuating the printing head the control program takes account of the predetermined height profile of the surface to be decorated in order to produce the predetermined desired paint layer thickness at the respective location on the surface to be decorated of the object. In the case of lacquering the bottom of a beverage can the printing head can precisely be actuated in such a way that the desired lacquer layer thickness in the region of the surface on which the can stands is greater than in other regions of the can bottom.

In order to provide a positional resolution which is as high as possible for differentiating points to be decorated on the surface to be decorated, it can be provided that in the decorating operation a plurality of printing nozzles, in particular a plurality of ink jet nozzles, is actuated independently of each other. It may be desirable in that case if the printing head has at least one line of such printing nozzles, wherein the length of the line can be adapted to the width of the surface to be decorated of the object.

For such a method according to the invention it is possible for example to use a conventional, single-line ink jet printing head having between 150 and 300 nozzles per inch. In addition however to increase the level of resolution it may also be desirable if there are two printing lines arranged in succession in the printing direction, the printing lines being displaced in the transverse direction by half the spacing between two printing nozzles so that the positional resolution with such a printing head is improved in comparison with a single-line printing head.

It may be desirable if the surface to be decorated is subdivided into individual decoration points. In addition it may also be desirable if an individual printing nozzle is associated with each decoration point. It will be appreciated that in that case the printing points can overlap on the surface to be decorated in order if required to provide a continuously printed surface.

A predetermined amount of paint for producing a predetermined desired paint layer thickness at the decoration point can be expelled from a printing nozzle associated with a decoration point.

It may be desirable if the paint is expelled as a liquid from the printing head or the printing nozzles, which dries on the surface to be decorated. That drying can be effected in dependence on the respective nature of the ink, for example thermally or by means of UV irradiation. To precisely establish a predetermined amount of paint at a predetermined decoration point on the object it can be provided that the drop size and/or the number of drops are established by way of the control program at the printing head for the respective printing nozzle.

It may be desirable if the time window available for the operation of printing a decoration point on the surface to be decorated is substantially constant for all decoration points so that the relative movement of the printing head and the object can also be effected uniformly, which greatly reduces the structural complication and expenditure in terms of carrying out the method. The time window can be used more or less for the printing operation, in dependence on the respective decoration point, for example in dependence on the amount of paint to be placed at the respective decoration point. In that respect the respective printing time for the decoration point can vary, the maximum printing time being limited by said time window.

It may be desirable if the amount of paint dispensed for a decoration point on the object is ascertained in dependence on the height profile or the topography of the surface to be decorated, at the decoration point. In that way it is possible to take account of the influences of the height profile on the deposit of the ink at the respective decoration point. For depositing the ink at a predetermined decoration point, for example the curvature of the surface to be decorated, at the specified decoration point, may also play a part. In that respect it may be desirable if the amount of paint dispensed for a decoration point on the surface to be decorated is ascertained in dependence on the angle between a tangent or a tangential surface relative to the surface to be decorated and a paint expulsion direction from the printing head at the decoration point. It is possible in that way for example to take account of the influence of gravity by virtue of the topography at the given decoration point. In a particular embodiment it can also be provided that the viscosity of the expelled ink is adjusted in dependence on the height profile of the surface to be decorated. For example, by adjusting the temperature of a drop leaving the printing nozzle, it is possible to alter the viscosity of that drop and thus the propagation of the drop on the surface to be decorated.

The method according to the invention can be adapted to any printing task and can be used for example to produce a homogeneous lacquer thickness which remains the same over the entire surface to be decorated, in spite of the existence of an irregular height profile for the surface to be decorated. On the other hand it is also in accordance with the invention for certain portions of the surface to be decorated to be coated with a given thickness of lacquer, which differs from the thickness of lacquer in other regions.

In a desirable embodiment it can be provided that the printing head is arranged stationarily and the object is moved substantially uniformly relative to the printing head. In that respect the movement of the object is adapted to the printing speed, that is to say the printing speed is synchronised with the relative speed between the printing head and the object.

The method according to the invention is suitable not only for applying an individual lacquer or an individual paint, but basically can also be used to apply lacquer or paints correlated to the topography of the surface to be decorated. For example it may be useful, with the use of a plurality of printing heads, to apply different lacquers or paints to different portions of the surface to be decorated, in each case in dependence on the respective topography of the portions. In the example already described hereinbefore of lacquering the bottom of a beverage can, for example the bottom can be printed upon with a first lacquer in the manner according to the invention while in a second step a second lacquer which in particular is abrasion-resistant can be applied to the surface on which it stands.

As described it is readily possible for predetermined portions of the surface to be decorated to be coated with different desired paint layer thicknesses so that a high level of paint application is effected only in such regions in which that is necessary and paint or lacquer can be saved in other regions.

In addition it may be desirable if the type of object to be decorated is automatically detected and, in dependence on the detected type, a predetermined printing control program which is associated therewith for producing predetermined printing on the surface to be decorated of the detected object is selected. If for example various containers of different shapes or with different height profiles are decorated with an apparatus according to the invention the method can be carried out automatically with the printing program adapted to the respective container.

The method according to the invention is also suitable for a decoration in which in a first printing operation the surface to be decorated of the object is provided homogeneously with a primer and in a second printing operation, using a downstream-connected printing head, the paint is applied non-homogeneously and in dependence on the topography of the surface to be decorated.

To be able to implement control of the printing head and the relative movement of the printing head and the object without involving a high level of complication and expenditure, it can be provided that the object is moved along a straight path relative to the printing head. In such cases in which the object or the surface to be decorated is rotationally symmetrical about an axis extending perpendicularly to that path, simple lateral guidance of the object is sufficient to guide the object past the printing head in relation thereto in a defined manner.

In order to start the printing operation in relation to each object in a defined manner, it can be provided that the relative position of the surface to be decorated relative to the printing head is ascertained and when a predetermined desired position is reached the printing operation is started by running the control program.

The method according to the invention can also be carried out for the creation of multi-color surfaces to be decorated by the use of a plurality of printing heads connected in series. In addition images or texts can also be applied to the surface to be decorated, which has a height profile. In regard to lacquering a bottom of a beverage can, the method according to the invention can also be used to lacquer only the surface of the can on which it stands, which itself also has a height profile.

In regard to the apparatus the invention attains the foregoing object with an apparatus for decorating an object having an uneven surface to be decorated, comprising a digital, contactlessly operating printing head controlled by a control device for dispensing paint on to the surface to be decorated. That printing head can be for example in the form of an ink jet printing head and can have one or more successively arranged printing nozzle lines.

It may be desirable if the apparatus has an optical sensor which detects an identity mark on the object, wherein the printing operation can be started in response to such detection. In a particular embodiment it can also be provided that the identity mark serves to detect the actual orientation of the object relative to the printing head and the object is brought into a desired orientation relative to the printing head prior to the start of the printing operation by means of an alignment unit.

BRIEF DESCRIPTION OF THE DRAWINGS

The invention is described hereinafter by the description of an embodiment with reference to the accompanying Figures in which.

DETAILED DESCRIPTION

The invention is described hereinafter with reference to lacquering the bottom of a beverage can. Such a beverage can is generally of a two-part design configuration and comprises in a one-piece structure a can body portion which is produced by way of a drawing-stretching shaping operation and which after filling of the can is closed with a lid. Hereinafter that lid can be disregarded as the invention is described with reference to lacquering of the can bottom.

Figure 1B:
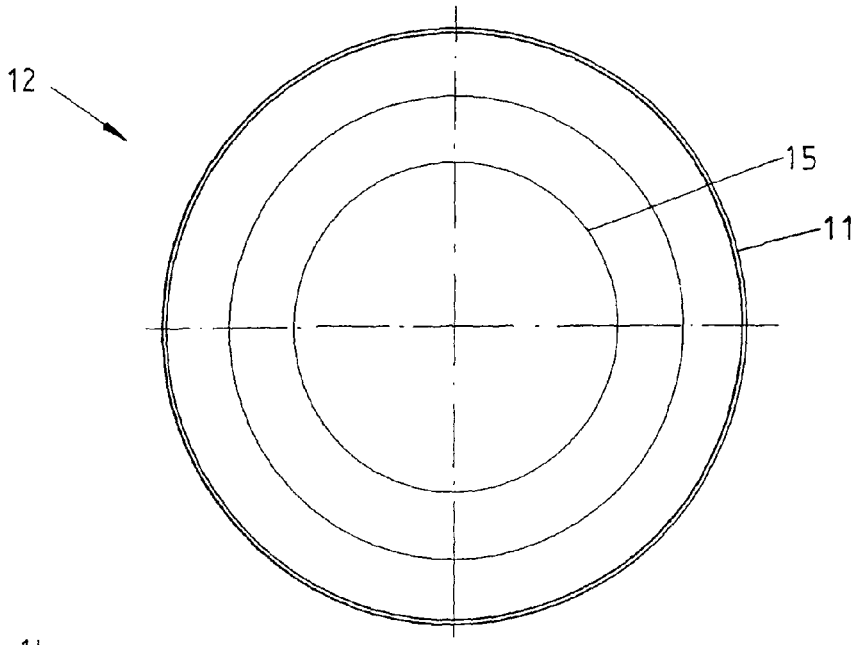
FIG. 1*b* shows a bottom view of the beverage can shown in FIG. 1*a*.
Figure 1A:
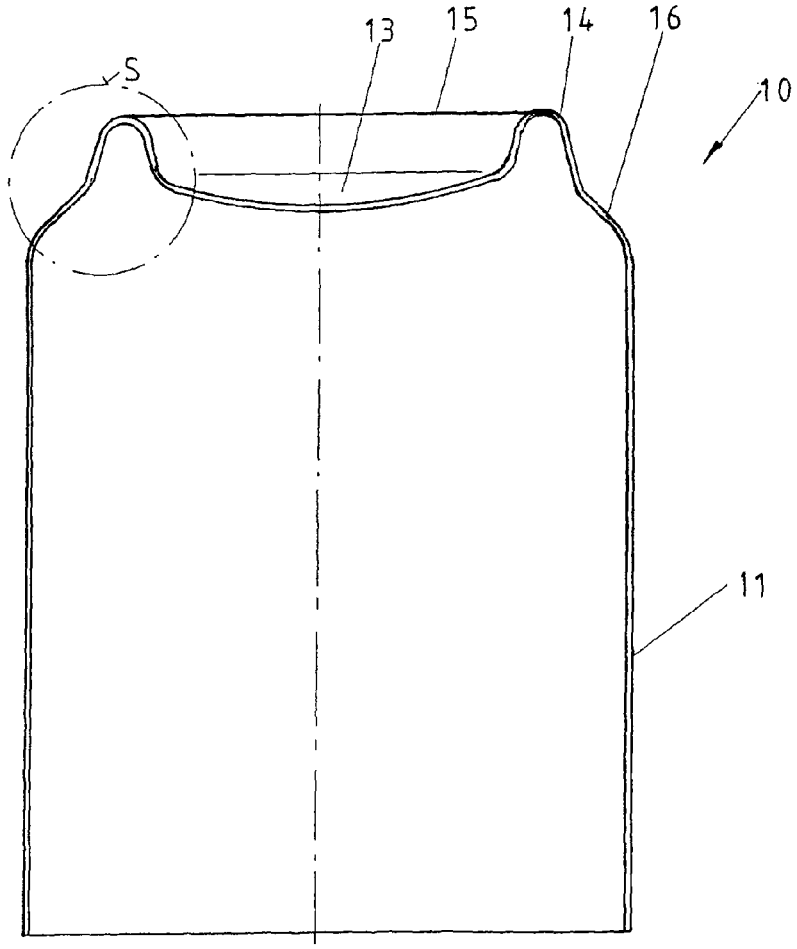
FIG. 1*a* shows a view in section of an object by way of example in the form of a beverage can.

FIG. 1*a* shows a sectional view of the can body portion in an upside-down position. FIG. 1*b* shows a plan view of the can bottom. The can body portion 10 is composed of a peripheral surface portion 11 and the actual bottom 12, reference 16 denoting a transitional region. Centrally relative to the axis the bottom has a domed portion 13 which radially outwardly goes into a support region 14 in the form of an annular ridge or outwardly curved portion. The extreme points, that is to say the lowest points in the base of the outwardly curved portion, extend on a circle 15.

When lacquering the bottom 12, application of the lacquer in the support region 14 is critical as that region is exposed to mechanical loadings. A particularly thick lacquer layer would be desirable in the support region 14 while the lacquer layer in the dome region 13 can be thinner.

Figure 2A:
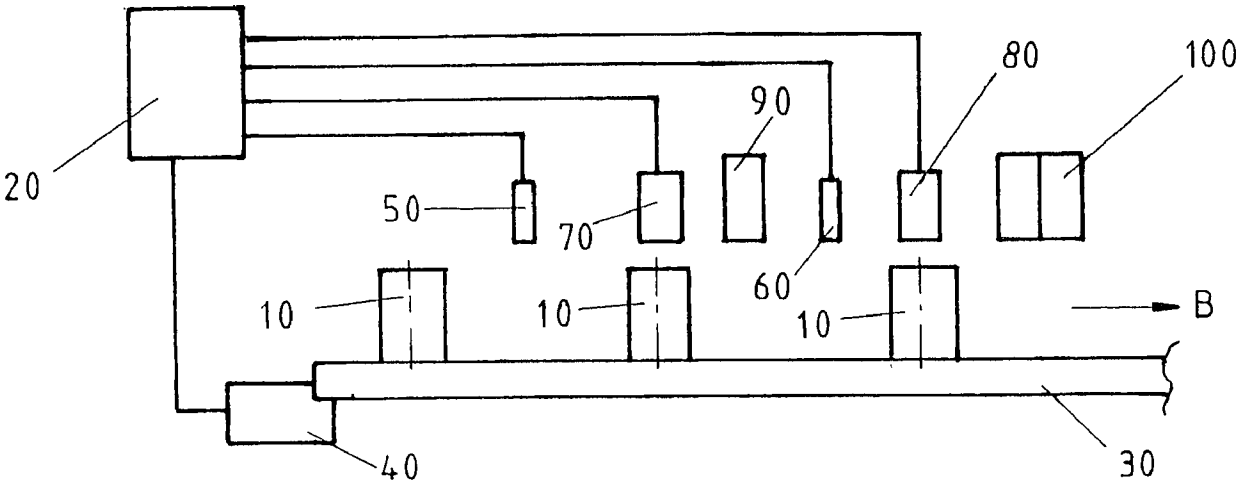
FIG. 2*a* shows a side view illustrating the principle of a printing apparatus according to the invention.
Figure 2B:
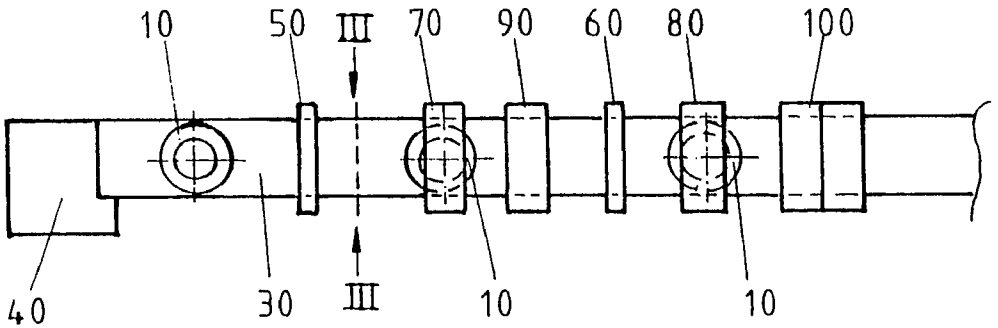
FIG. 2*b* shows a plan view of the printing apparatus shown in FIG. 2*a*.

Those requirements can be met with the printing apparatus according to the invention shown in FIGS. 2*a* and 2*b*. The apparatus includes as essential components a conveyor belt 30 which is driven by a drive 40 and which moves the upside-down can body portions 10 uniformly and on a straight path in the direction of the arrow B. In the printing apparatus shown in FIGS. 2*a* and 2*b*, arranged in succession in the direction of movement are a sensor device 50, an ink jet printing head 70, a drying station 90 with a UV tube, a further sensor 60, a further ink jet printing head 80 and a further drying station 100 which has two UV tubes which are arranged in succession in the direction of movement and with their respective longitudinal axis perpendicular to the direction of movement of the conveyor belt.

The two sensors 50, 60, the two ink jet printing heads 70, 80 and the drive 40 for the conveyor belt 30 are connected to a central control device 20. The single-line ink jet printing head 70 is used in that case for printing on the entire bottom 12 including the domed region 13, the support region 14 and the transitional region 16 while the downstream-connected single-line ink jet printing head 80 serves solely for again printing on the support region 14. Both printing heads each have a line of 550 equidistantly spaced nozzles on a length of 70 mm, each printing nozzle being individually actuable for expelling ink.

The overall procedure involved in the printing method will be described hereinafter, The cans 10 are placed on the conveyor belt in an input station (not shown) and move in succession in the conveyor direction B. In that respect the conveyor speed of the conveyor belt 30 is adapted to the printing speed of the printing heads 70, 80 and in the described embodiment is constant at any time as long as the conveyor belt is being moved. If the sensor 50 which is in the form of a light barrier arrangement detects the approach of a can 10, the corresponding sensor signal is used by the control device 20 to actuate the printing head 70, having regard to the spacing of the sensor 50 relative to the printing head 70 and the speed of the belt 30, for printing on the entire bottom 12, see FIG. 1*b*. As the beverage can is of a rotationally symmetrical configuration relative to its longitudinal axis, the relative position of the surface to be decorated, with respect to the printing head, is ascertained with detection of the can, by the light barrier arrangement.

In that case the control device 20 calls up a previously created and stored control program for controlling the printing head 70, in the creation of which the height profile of the bottom was taken into consideration for establishing the amount of ink for each individual printing point on the bottom. In the described embodiment, the step of establishing the control program involves the spacing of the respective printing head relative to the respective printing point and the angle of inclination of the bottom at the printing point relative to the ink jet direction. A paint layer thickness which remains the same is the aim in that respect, in the dome region 13 and in the transitional region 16, while the desired paint layer thickness is to be set to be as great as possible in the region of the support surface 14. That is implemented in the printing operation by a printing nozzle which is to be actuated to print a printing point within the support surface 14 being actuated to expel an amount of paint which is as large as possible. The described embodiment uses printing heads which can vary both the expulsion amount and also the number of drops of the ink dispensed for each printing point.

To produce a substantially constant paint layer thickness in the region of the dome and in the transitional region, the respective curvature of the portions and the distance of the printing point relative to the printing nozzle are taken into consideration when creating the printing control program. That will be discussed in greater detail hereinafter with reference to FIG. 4.

After the first printing on the can 10 by the printing head 70 the can is moved by way of the conveyor belt 30 to the drying station 90 in which pre-drying of the applied ink is effected before the second printing operation. As described the belt moves at a constant speed if the radiation power of the UV tube in the drying station 90 is so set that the desired pre-drying of the ink can occur while the can is moving through beneath the UV tube.

Then the can is transported completely out of the drying station 90 and is detected by the second light barrier arrangement 60 which delivers a corresponding signal to the control device 20 which then actuates the second printing head for again printing on the support region 14 of the can 10. The printing control program for the printing head 80 differs in that respect from the control program of the printing head 70. In the second printing operation, in the printing line of the printing head, it is only ever the respective printing nozzles which are associated in fact with printing points of the support surface 14, that are actuated to dispense ink. In addition the amount of ink dispensed for an individual printing point in the support surface is also calculated in dependence on the curvature at the point to be decorated, that s to say the topography, and in dependence on the spacing of the printing nozzle relative to the point to be decorated. After the second operation of printing on the support surface 14 the can is moved into a second drying station 100 which is longer in the direction of movement and in that respect affords a longer residence time for the can for complete drying of the total ink applied. The terms used here ink, paint and lacquer are to be interpreted as synonymous.

Figure 3:
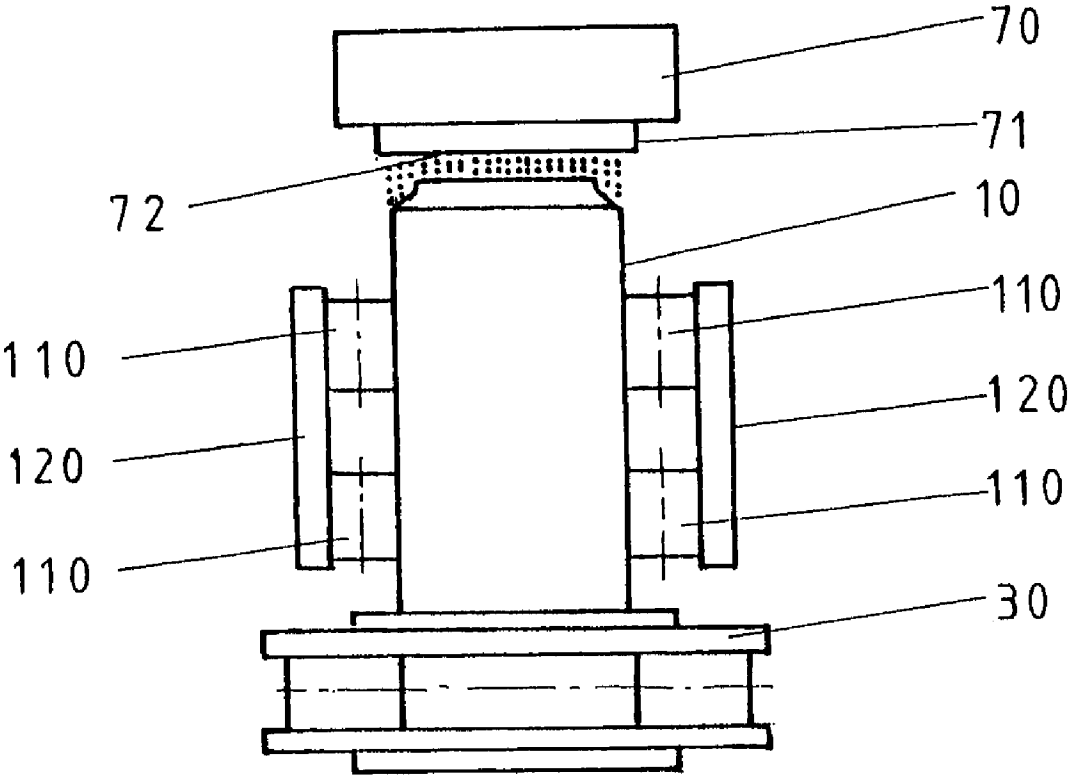
FIG. 3 shows a view in detail illustrating the lateral guidance for the object in a printing apparatus according to the invention.

FIG. 3 shows a sectional view of the printing apparatus illustrated in FIG. 2*b*, along lines III-III. Shown there is a can 10 which is just disposed portion-wise beneath the ink jet printing head 70. The printing head has the individual printing line 71 already described, which includes the multiplicity of mutually juxtaposed printing nozzles 72. The printing line is adapted in its width to the diameter of the beverage can 10 so that the transitional region 16, the support region 14 and the dome region 13 of the bottom 12 of the can 10 can be printed upon, see FIGS. 1*a* and 1*b*. In the illustrated snapshot all nozzles are actuated to dispense ink.

To laterally orient the cans 10 in relation to the printing line 71, there is provided a lateral guide device which for the sake of simplicity is not shown in FIGS. 2*a* and 2*b*. It includes rotatable rollers 110 fixed to associated roller holders 120. The axes of rotation of the rollers extend parallel to the longitudinal axes of the cans. The cans are held laterally with a very small amount of play between the guide rollers and are thus oriented relative to the printing head. As the bottom region of the beverage can being printed here is rotationally symmetrical about the longitudinal axis thereof, there is no need for rotational orientation of the can prior to the printing operation. To prevent the can rotating when being conveyed on the conveyor belt 30, it is provided (in a manner not shown) that the can is held on the conveyor belt in such a way as to be unable to rotate, for example by means of a vacuum suction. In that respect the vacuum suction is only operative after the cans are oriented relative to the printing line 71.

In embodiments which are not shown the printing apparatus according to the invention can have still further printing heads, in particular also multi-line printing heads.

Figure 4:
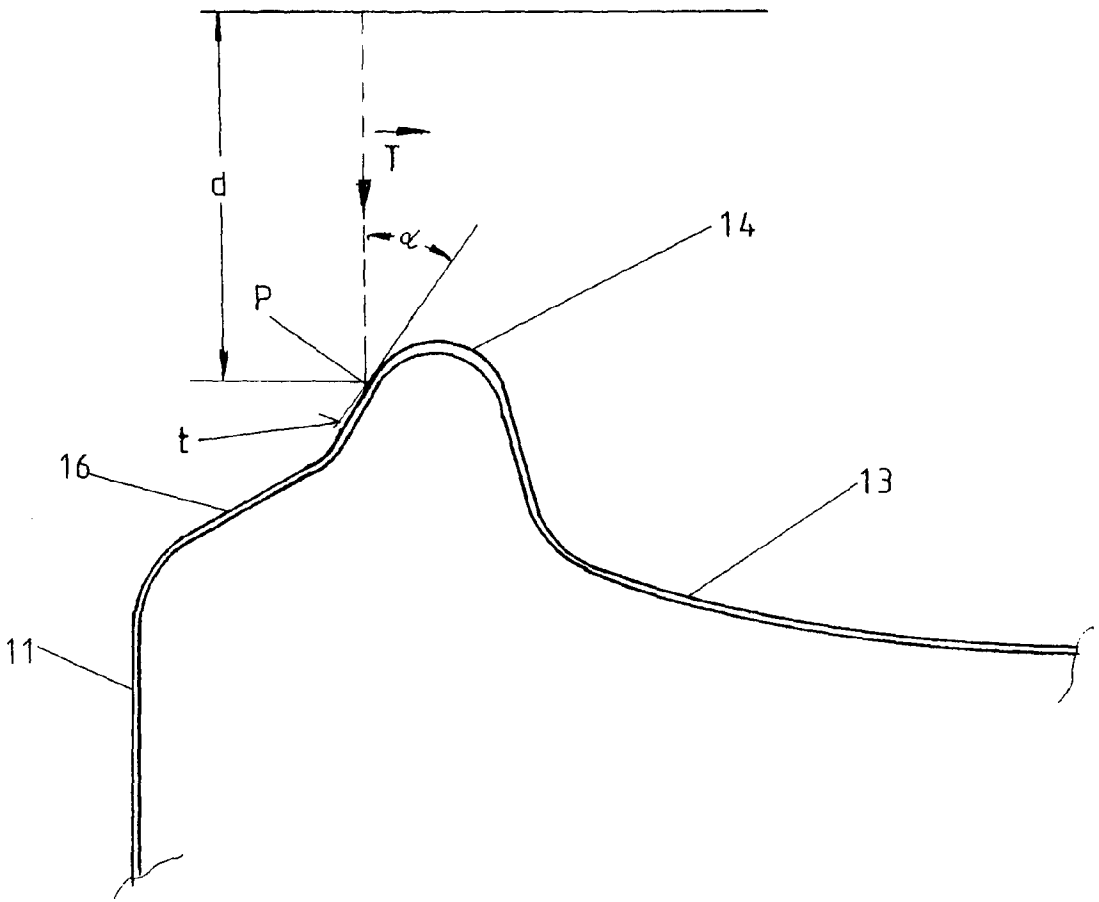
FIG. 4 shows a detail view of the support surface of the object shown in FIG. 1*a*.

Reference is now made to FIG. 4 to describe hereinafter by way of example the way in which the height profile of the surface to be decorated is taken into consideration in the operation of printing thereon or in the creation of a control program for actuating a printing head. The Figure shows in detail the part S illustrated in FIG. 1*a*, wherein in addition the printing point P just being printed, the tangent t at the printing point P, the jet direction T of the ink dispensed by the printing head and the spacing d of the respective printing nozzle relative to the printing point P are illustrated here. In that respect the horizontal line in FIG. 4 reproduces the relative position of the printing line relative to the surface to be decorated.

There is an angle $\alpha$ between the tangent t and the jet direction T. To take account of the influence of the curvature of the bottom at the point T, the described embodiment provides that the amount of ink to be dispensed is scaled with the factor $1/\sin(\alpha)$ at each printing point of the surface to be decorated, for a predetermined range of $\alpha$. In addition the amount of ink to be dispensed can be scaled with a factor (d-c), wherein c is a constant.

Other contactlessly and digitally operating printing devices can also be used in embodiments which are not shown here, for example electrophotography printing or magnetography printing devices.

LIST OF REFERENCES

10 can body portion
11 peripheral surface portion
12 bottom
13 dome
14 support region/ridge
15 circle at the bottom of the ridge
16 transitional region
20 control device
30 conveyor belt
40 drive
50,
60 sensor

70 ink jet printing head
71 printing line
72 printing nozzle
80 ink jet printing head
90,
100 drying station
110 guide rollers
120 roller holders
α angle between jet direction T and tangent t
B direction of movement of the beverage can
d spacing between printing nozzle and printing point
P printing point
S portion
T jet direction of the ink
t tangent

The invention claimed is:

1. A method of decorating an uneven surface of an object which is dimensionally stable by a printing operation, wherein the object to be decorated and a digitally and contactlessly operating printing head are moved relative to each other during the printing operation and the printing head is actuated by a control device for dispensing ink, comprising the steps:

creating a control program for controlling the printing head in dependence on the height profile of the uneven surface to be decorated of the object;

detecting the relative position of the surface to be decorated of the object relative to the printing head;

actuating the digital printing head with the created control program; and wherein prior to the decoration operation a desired ink layer thickness is established in dependence on the location of the uneven surface to be decorated of the object and the control program is created in dependence on the predetermined height profile of the surface to be decorated and the desired ink layer thickness, wherein the digital printing head is controlled with the created control program in response to the topography of the uneven surface to be decorated to produce the predetermined desired ink layer thickness in dependence on the location on the surface to be decorated of the object.

2. The method of claim 1, wherein the ink is expelled from the printing head as a liquid which dries on the surface to be decorated and that the application of a predetermined amount of ink at a decoration point of the object is established by the choice of the drop size and/or by the choice of the number of drops of the dispensed ink.

3. The method of claim 1, wherein the respective time window available for printing the decoration point on the surface to be decorated is substantially constant.

4. The method of claim 1, wherein the amount of ink to be dispensed for a decoration point is ascertained in dependence on the topography of the surface to be decorated at the decoration point.

5. The method of claim 1, wherein in the decorating operation a plurality of printing nozzles, in particular a plurality of ink jet nozzles, is actuated independently of each other.

6. The method of claim 1, wherein the printing head is arranged stationarily and the object is moved substantially uniformly relative to the printing head.

7. The method of claim 1, wherein the printing head is actuated in such a way that the ink layer thickness is substantially constant over the surface to be decorated independently of the topography of the surface to be decorated.

8. The method of claim 1, wherein the printing speed is synchronised with the relative speed of the printing head and the object.

9. The method of claim 1, wherein different ink correlated with the topography of the surface to be decorated are applied.

10. The method of claim 1, wherein at least two predetermined regions of the surface to be decorated are coated with ink of different desired paint layer thicknesses.

11. The method of claim 1, wherein the type of object to be decorated is detected and a printer control program associated therewith is selected in dependence on the detected object.

12. The method of claim 1, wherein after a first printing operation in which the surface to be decorated of the object is homogeneously decorated, a second printing operation is carried out, in which ink is applied nonhomogeneously and depending on the topography of the surface to be decorated by a second digital, contactlessly operating printing head which is disposed downstream of the first digital printing head.

13. The method of claim 1, wherein the object is moved along a straight predetermined path relative to the printing head.

14. The method of claim 1, wherein the relative position of the printing head with respect to the surface to be decorated, for the decoration operation, is detected and thereupon the decoration operation is started.

15. The method of claim 1, wherein the uneven surface comprises a surface of a beverage container and wherein the desired ink layer thickness is greater in a support region of the container than in the dome region.

16. The method of claim 4, wherein the amount of ink to be dispensed for a decoration point of the surface to be decorated is ascertained in dependence on the angle between a tangent or a tangential surface to the surface to be decorated and an ink expulsion direction from the printing head at the decoration point.

17. The method of claim 5, wherein associated with a predetermined decoration point in the surface to be decorated of the object is at least one printing nozzle from which a predetermined amount of ink is dispensed to produce the predetermined desired ink layer thickness at the predetermined decoration point.

18. Apparatus for decorating an uneven surface of a beverage container, comprising: a digital, contactlessly operating printing head controlled by a control device for dispensing ink on to the surface and a device for creating a control program for controlling the printing head in dependence on the height profile of the uneven surface to be decorated, wherein prior to the decoration operation a desired ink layer thickness is established in dependence on the location on the uneven surface of the beverage container and the control program is created in dependence on the predetermined height profile of the surface and the desired ink layer thickness, wherein the digital printing head is controlled with the created control program in response to the topography of the uneven surface to be decorated to produce the predetermined desired ink layer thickness in dependence on the location on the surface to be decorated of the object.

19. The apparatus of claim 18, wherein the printing head is in the form of an ink jet printing head and has at least one row of ink jet nozzles.

20. The apparatus of claim 18, wherein at least two printing heads are arranged in succession in the direction of movement of the object.

21. The apparatus of claim 19, further comprising a sensor for detecting the position of an object.

* * * * *